United States Patent [19]

King

[11] Patent Number: 4,510,956

[45] Date of Patent: Apr. 16, 1985

[54] WALKING AID, PARTICULARLY FOR HANDICAPPED PERSONS

[76] Inventor: Lorraine King, 201 W. 89th St., New York, N.Y. 10024

[21] Appl. No.: 522,999

[22] Filed: Aug. 15, 1983

[51] Int. Cl.[3] ..... A61H 3/04

[52] U.S. Cl. ..... 135/67; 272/70.3

[58] Field of Search ..... 135/67, 66, 65; 297/5, 297/6, DIG. 4; 272/70.3, 70.4; 280/647, 648, 649, 650, 43.14, 87.02 R, 87.02 W, 87.04 R, 62, 755; D12/130

[56] References Cited

U.S. PATENT DOCUMENTS

| | | | |
|---|---|---|---|
| 658,126 | 9/1900 | Settlemyre | 280/87.02 W |
| 1,307,058 | 6/1919 | McGrath . | |
| 2,077,569 | 4/1937 | Kish . | |
| 2,362,466 | 11/1944 | Carter . | |
| 2,402,330 | 6/1946 | Janosko | 272/70.4 |
| 2,745,465 | 5/1956 | Hogan | 297/6 |
| 2,792,052 | 5/1957 | Johannsen . | |
| 3,054,623 | 9/1962 | Simpkins | 280/43.14 |
| 3,130,814 | 4/1964 | Aquila | 272/70.3 UX |
| 3,195,550 | 7/1965 | Ingalls . | |
| 3,354,893 | 11/1967 | Schmerl . | |
| 4,046,374 | 9/1977 | Breyley | 272/70.3 |
| 4,068,857 | 1/1978 | Karlsson | 272/70.4 X |
| 4,226,413 | 10/1980 | Daugherty | 272/70.4 |
| 4,251,105 | 2/1981 | Barker | 297/6 |

FOREIGN PATENT DOCUMENTS

| | | | |
|---|---|---|---|
| 1330189 | 5/1963 | France | 272/70.3 |
| 2274274 | 1/1976 | France | 135/67 |
| 698775 | 10/1953 | United Kingdom | 297/5 |

OTHER PUBLICATIONS

Walking Aid Catalog, "LUMEX".

*Primary Examiner*—Robert A. Hafer
*Assistant Examiner*—Arnold W. Kramer
*Attorney, Agent, or Firm*—Frishauf, Holtz, Goodman & Woodward

[57] ABSTRACT

To provide support and protection for an impaired person, a four-corner lower frame is provided, made of heavy metal, to insure a low center of gravity, which has two wheels at the rear corners operable about fixed axes of rotation, and a single central front caster wheel. The four corners of the frame, which is of generally U-shape, for example in form of an open square or rectangle, are formed with projecting spurs which project downwardly, with clearance from the ground surface, over which the walker is to operate, of about 1 cm. An upper frame, with padded arm rests and a forward front portion including a steering bar, is provided, secured to the lower frame by uprights located behind the center of the side legs, preferably close to the rear wheels, to provide a support for the person, for example by resting the elbows and forearms on the arm rest, with the hands grabbing the steering bar. Tilting the entire frame backwards, only slightly, will cause the rear spurs to engage the ground, thus providing braking, for example on an inclined surface; the two forward spurs at the forward corners of the open U provide assurance against tipping, and additional braking.

19 Claims, 9 Drawing Figures

WALKING AID, PARTICULARLY FOR HANDICAPPED PERSONS

The present invention relates to a walking aid, particularly for invalids, elderly people, convalescents, and, in general, to persons who are handicapped in not being able to place their weight on their legs, while being capable of using the legs to move about.

BACKGROUND

Various walking aids are known in which tubular elements are assembled in frame structures which can either be grasped by the hands of the user or which can support the user in the armpit, similar to crutches. Some of those frame structures may have wheels, either two at the rear of the user, or two forwardly thereof, or surrounding the user. Most such support structures are made of aluminum, or other light-weight material, to insure portability and ease of handling by an impaired or elderly person. While light-weight materials of sufficient strength are readily available, a compromise between stability of the structure in the face of external forces acting thereon, for example when used on public streets or in crowds, with ease of use and portability must be made, and the choice, usually, dictates a structure which is as light as possible to place low strain on the user when employing the walking aid.

Some walking aids have a lower frame, for example roughly three sides of a square or rectangle, with wheels at the respective four corners; another construction utilizes a U-shaped frame, for example bent in partcircular form, with a group of wheels around the circumference, so that a person supporting her/himself on elevated portions of the frame can move about while pushing the wheeled frame along. Wheeled walkers generally are intended for institutional use, for example for learning to walk after a trauma; non-wheeled walkers can be used both indoors and out, but have the disadvantage that they have to be tipped forward and lifted in cadence with each step of the user.

THE INVENTION

It is an object to provide a walking aid which permits an impaired person to move about freely, indoors and out, while being able to negotiate differences in surface height over a rolling surface, for example up and down curbstones, over potholes or other irregularities in a road or sidewalk surface without loss of stability or assurance to the user that the user will not fall and is in continuous control of the walking aid, as well as of the user's upright position, while also permitting use on inclined surfaces without danger of the wheeled walking aid rolling away out of control by the user.

Briefly, the walking aid is made of a frame of generally U-shaped configuration, which may partly be of heavy metal, such as tubular steel, and partly of lighter weight metal, such as tubular aluminum. Two wheels are mounted laterally at the respective legs adjacent the free end portions thereof for rotation about fixed axes, extending transversely of the U-shaped frame. A single forward caster-type wheel, or dual-wheel unit, is provided, arranged for swiveling about a forward swivel axis, and positioned centrally on a connecting element which connects the two legs of the U-shaped structure together. A wheel of about 12½ cm (5") diameter, with a tire, is most suitable. If much smaller, it may not roll readily over obstructions. Casters have excessively hard surfaces. Much larger wheels make the structure inconvenient for the user. The single caster-type wheel, or wheel unit, permits steering of the walking frame around, through and over obstructions without the danger present in two forwardly positioned wheels of being caught, for example, in obstructions such as a ridge in the support surface, e.g. a sidewalk. The lower U-shaped frame supports a pair of upright struts which are located laterally thereof, that is, extend upward from the sides of the U-shaped frame, to which another U-shaped structure is attached, also of generally open or three-sided square or rectangular configuration. The height of the upper support structure is preferably adjustable to suit the preference of the user on the upright struts. In accordance with a feature of the invention, the upright struts may be connected to the sides of the U-shaped structure by connecting support struts to form triangle connections leaving, however, the forward portion or cross connection or bend portion of the upper and lower U-shaped structures free and unobstructed.

To provide stability with respect to irregularities of the frame, and to permit ready control of movement thereof, the frame is formed, in accordance with a feature of the invention, with a plurality of downwardly extending spurs which, when the walking aid is placed on a flat surface, terminate just short of the surface, that is, provide some clearance with respect thereto. Should the frame tip, the spurs will engage the ground, and thus inhibit toppling over and provide assurance to the user that a solid, immovable support is provided. Should the walking aid be operated on an upwardly inclined or sloping surface, and have the tendency to roll back against the user, it is only necessary for the user to tip it upwardly in front, so that the rear spurs will engage on the ground and act as brakes; or on a downwardly sloping surface, and should the frame be running away forwardly, the user can lean towards one side, whereupon the one or the other of the forwardly positioned spurs will engage the ground level and form a brake. The user, thus, has the utmost assurance of support and control.

The upper surface preferably is finished with a wide and padded platform, for engagement, for example, by the elbows and forearms of the user, or may be built to a height allowing handpressure only. It may be secured to the uprights by a spring connection, for example a stiff spiral spring retained within the tubular structure of the uprights.

The frame members preferably are inset at the top to partly encircle closely the user's body and ease weight bearing on the arms while, at regions remote therefrom, they are splayed outwardly to prevent inadvertent tipping, or interference with the user by jostling, particularly when used in public and in crowds. The outward splaying also reduces the possibility of the user inadvertently running a wheel of the walker over his own feet.

Since the walker is stable, even if loaded unsymmetrically, the user has one arm and hand and, under some situations, also the other hand free for tasks of ordinary life. Thus, the user can lean on one side with her/his forearm, and have the other entirely free, e.g. for telephoning, writing, or the like. Both hands can be free, with the user only leaning with the elbows on the platform support. The structure, thus, substantially improves the quality of life for a disabled person. The freedom to move both hands, while permitting upright support of the user on the elbows, is particularly important to allow tasks to be carried out by the hands, and is especially valuable for children.

DRAWINGS

DETAILED DESCRIPTION

Figure 1:
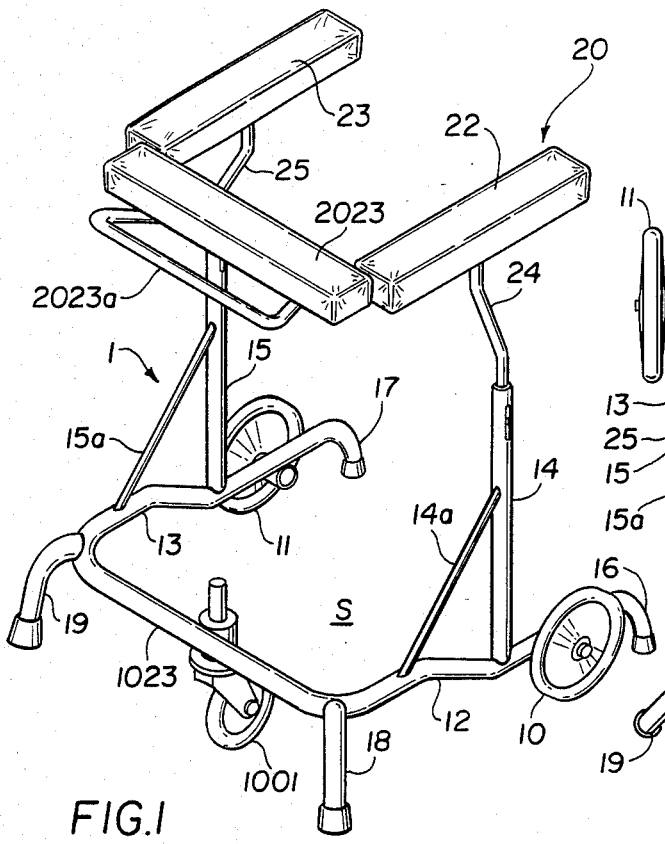
FIG. 1 is a front perspective view of the walking aid.

The walker has a frame 1 and is adapted to operate over a surface S. It has a lower U-shaped structure formed by two legs 12, 13 and a cross element 1023. Two wheels 10, 11 are connected to the legs 12, 13, respectively, to rotate in planes perpendicular to the surface S, and about axles providing an axis of rotation transverse to the legs 12, 13. In accordance with a feature of the invention, the forward or cross connecting portion 1023 of the frame is supported by only a single support wheel 1001 which is formed as a swivel caster wheel capable of swiveling about a vertical axis, and rotatable in vertical randomly positioned planes. The swivel caster wheel is shown as a single wheel element but, of course, may also be a dual wheel assembly, for example two separate wheel elements located side-by-side immediately adjacent to the swivel axis.

Vertical upright struts 14, 15 are secured to the legs of the lower U-shaped frame structure. There are no other upright elements at the forward portion, leaving it unimpeded, and giving the forward portion of a support surface 20, secured to the upper end of the upright struts 14, 15 some amount of springiness or resiliency. To allow dismantling of the frame into two sections, connecting struts **14*a*, 15*a* are provided to form together with the legs 12, 13** of the U a triangle structure which, as well known, is stable.

Figure 2:
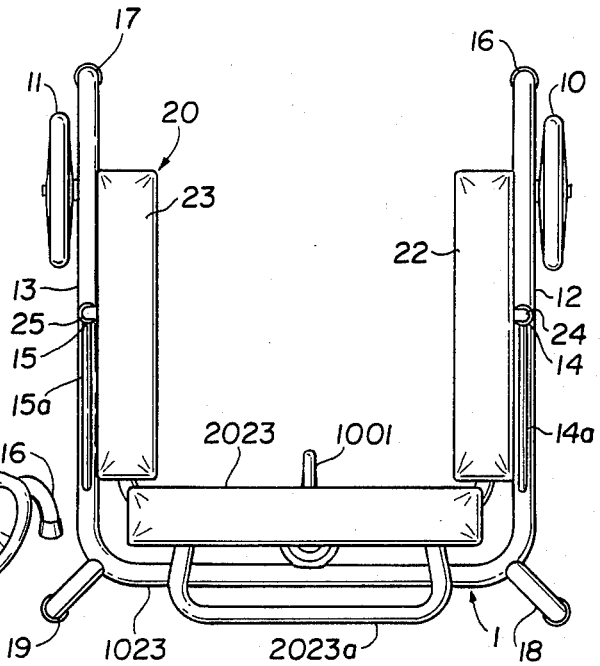
FIG. 2 is a top view.

The support surface 20 is U-shaped in plan view—see FIG. 2, and heavily padded. It has two parallel legs 22, 23 and a connecting portion 2023. The connecting portion can be extended to form a hand grip or grab bar **2023*a*** to assist negotiating curbs which also can be used to attach a carrying basket, bag or the like, for the convenience of the user.

In accordance with an important aspect of the invention, the four corners of the U-shaped frame structure have dependent spurs 16, 17, 18, 19 formed thereon, extending, for example, in bent-over curved form towards the support surface S. They terminate just short of the support surface S and, preferably, include rubber or plastic bushings or tips thereon, spaced by a suitable distance, e.g. about $\frac{1}{2}$ to $1\frac{1}{2}$ cm from the support surface. The rear spurs 16, 17 can be shaped to be integral with the ends of the legs 12, 13 of the lower support. The front spurs 18, 19 preferably extend forwardly and downwardly, for example being welded to the U-shaped frame at approximately the region of juncture between the legs 12, 13 and the connecting element 1023. The legs 12, 13 are preferably offset upwardly. This provides a lower center of gravity for the structure close to the rear wheels while easily permitting tipping of the upwardly forward portion, if it is desired to engage the rear spurs 16, 17 with the ground surface, for example to prevent run-away of the walker beyond the walking capability of the user if the walker is used on an inclined surface, e.g. a ramp or the like. Assurance of non-tipping and solid support to the user is provided by the forward spurs 18, 19 whick prevent the frame from toppling diagonally and, if the user rests the forearms on the legs 22, 23 of the support surface 20, the walker is easily controllable. Slight tipping of the frame, at the forward side, towards the right or left, for example by leaning on the side, will engage the respective spur 18, 19 and thus provide reliable support and safety to the user, while effectively inhibiting tipping of the structure. Yet, rolling stability is insured by the three-point suspension of the structure by the three wheels.

Figure 4:
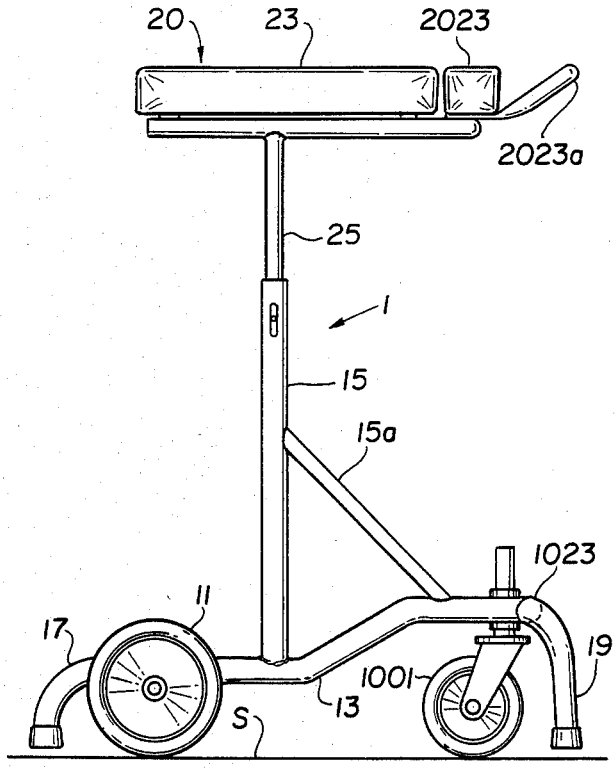
FIG. 4 is a side elevational view.
Figure 3:
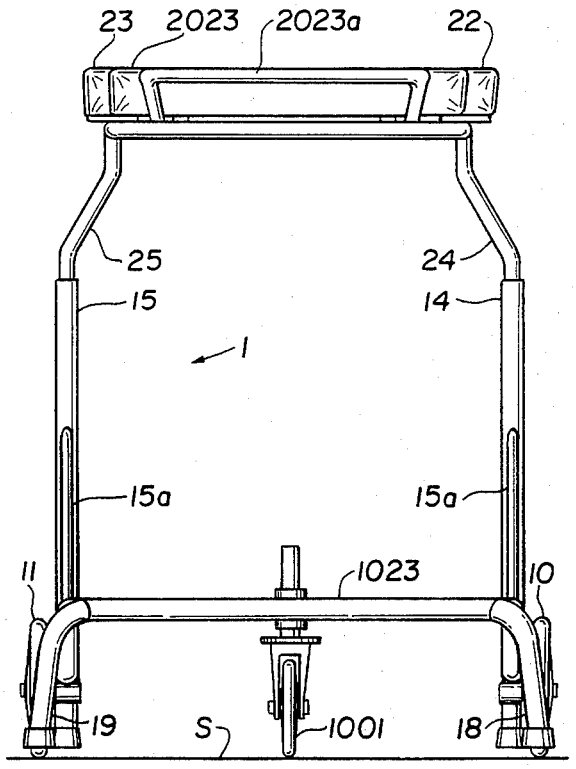
FIG. 3 is a front elevational view.
Figure 6:
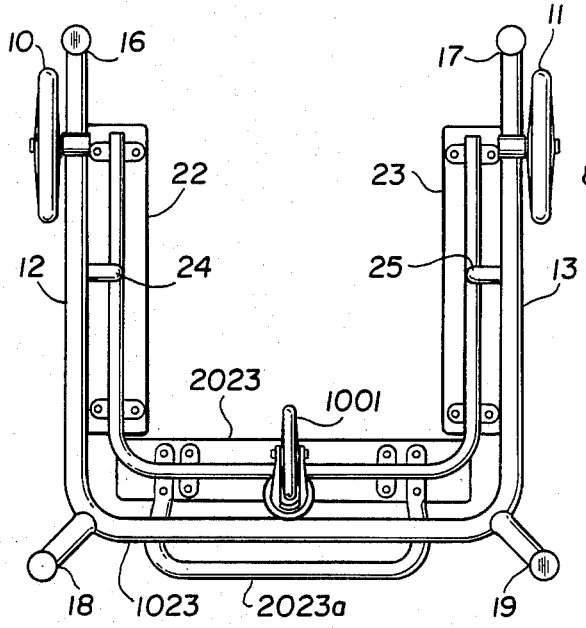
FIG. 6 is a bottom view.

To additionally enhance the stability, and in accordance with a feature of the invention, the swivel axis of the forward caster wheel is offset with respect to the engagement points of the forward spurs 18, 19 so that, in plan view, the end portions of the forward spurs 18, 19 and the swivel axis form a triangle, rather than a less stable in-line position. The triangular configuration is additionally insured by so placing the engagement surface of the caster wheel with the support surface S that, in forwardly moving operation, the engagement point of the wheel with the support surface is substantially forwardly, or, preferably, rearwardly of the spurs 18, 19, as best seen, for example, in FIG. 4.

The lower frame structure, that is, elements 12, 13, 1023, preferably are made of tubular steel. The upper structural elements are made of lighter weight material to place the center of gravity of the walker as low as possible. Thus, the support struts 14, 15 may be made in the upper parts, of tubular aluminum. The lower level is three sides of a square, with the ends of the free sides tipped down to form the spurs 16, 17. The rear wheels 10, 11, for example, are 7-inch diameter wheels, secured to the rear of each free side of the square, forward of the adjacent spurs 16, 17, the central axle of each wheel being attached to the underside of the metal tube forming the lower frame. The caster wheel may, for example, be a 5-inch diameter caster, secured to the cross element 1023 at the inside thereof, located centrally, to allow for multi-directional turning. The enclosed side of the square is three inches higher than the free sides, by offsetting upwardly the legs of the lower frame section in the region of the portion adjacent the cross element 1023, in order to provide a lower frame which will stand on its wheels with frame elements which, throughout their major extent, are located in a plane essentially parallel with the ground or support surface S. The four spurs 16–19 are all spaced about the same distance from the ground, with a clearance of about 1 cm (roughly $\frac{3}{8}$ inch) between the tips of the spurs and the ground surface, and protected by suitable protecting sleeves or tips to prevent scraping and slippage.

The upstanding struts 14, 15 are constructed as multiple elements, preferably as steel tubes welded to the sides of the frame, consistent with the needs of the user. The mounting is slightly rearwardly from a center line of the legs, the tubes forming an outer sleeve for telescopically received support elements 24,25, so that the support surface 20 together with downwardly projecting tubes 24,25, e.g. of aluminum, therefrom is detachable. The telescopic action of the large tubes over the smaller upper tubes also permits height adjustment of the support surface. Preferably, the inner and outer telescopically received tubes are locked together by connecting bolts. To allow for some resiliency, a spiral spring, preferably stiff, so as not to decrease the user's confidence in structural stability, can be received within the lower tube. The connecting bolts are then passed through elongated slots in one of the telescopic tubes to permit the tubes to have some additional "give" upon placement of a weight on the support surface.

The downwardly projecting tubes or struts 24, 25 which are secured to the top surface 20 are bent or offset inwardly from their engagement with the lower tubes forming the struts 14, 15 and secured to the lower frame to center the support surface over the base, small enough to fit around the user, for example just below the waist. The somewhat larger bottom frame, which is heavier, thus provides for excellent stability while additionally providing for protection of the user, for example in public places or crowds, while permitting the user to make suitable long strides.

The support surface 20 is formed of metal, preferably light-weight platforms; other suitable materials may be used; they are secured to the top of each end of the upper tubes 24, 25 fitted into the struts 14, 15 to form an essentially open square or rectangle—see FIG. 2. The metal plates can be used as support surfaces to attach padding blocks thereto, for example to retain wooden bases, on which a suitable foam-rubber block is secured, for example by an adhesive. A 5 cm thickness block is suitable, the foam-rubber blocks then being covered with leather or leather substitute, the edges being finished underneath the metal bases.

A continuous handlebar 2023*a*, preferably of Al-alloy tubing and covered with a soft plastic, a leather sleeve or the like, is attached in advance of the cross element 2023 of the upper surface. This handlebar facilitates steering, forms a protective "bumper" and, additionally, permits attachment of a carrying bag or the like.

The entire walking aid provides excellent stability since the majority of its weight is close to the ground, by use of steel tubing for the lower frame. The weight of the user is distributed throughout the sides and not only at the corners. The struts 14, 15; 24, 25, positioned with respect to the user to be located essentially under elbows if the forearm is placed on the legs 22, 23 of the support surface provide some give and springiness without, however, endangering stability. The stability is insured by the four spurs 16–19, which prevent sideways tipping and under- or overrunning. Additional stability is afforded by the convergence of the upright struts 14,15–24,25, that is, by making the frame of the base larger than the top. This allows the user to walk, continuously, within the frame rather than pushing it forward and away as the center of gravity of the user shifts with respect to the frame, as in a walker. The wheeled frame as described permits operation or rolling movement of the frame and support via the elbows, thus leaving the hands free for normal occupation. Only complex steering, e.g. over or around obstructions, requires that the hands be returned to the frame.

Various modifications and changes may be made. For example, if the frame is to be used with someone who may be given to falling, a simple latch hook can be attached to each side of the top support surface, and the user supplied with a belt with a ring at each side, fitted into the latch hook, similar to safety belts being used by outside window cleaners and the like.

For small persons, it may not be possible to form the upright struts 14, 15, 24, 25 as two height adjustable elements. The triangular stabilizing struts 14*a*, 15*a* preferably extend at an angle of about 45° with respect to the legs of the base and are secured to the uprights, or base elements, respectively, at between about 30–50 cm from the juncture of the upright supports and the legs of the bottom frame.

For some users, it may be desirable to provide hand grips; the vertical struts 14, 15 thus can be formed with T-bars at the top thereof, possibly with raised hand grips at each end, to prevent the user's hands from slipping off forwardly or backwardly. The forward portion is high enough to allow the frame to be propelled forwardly by the inner edge of the hand. The grips, preferably, are to be padded with foam and leather, and thus act as comfortable walking canes which always remain upright in the same position last used and do not require lifting and stepping the cane along in cadence with walking. Rather, this support cane moves on the wheels, but does not tip or wiggle sideways since it is constrained in position by the entire frame.

In accordance with a feature of the invention, the basic frame can be modified to form a folding frame, so that the walking aid can be folded to a width of approximately half that when in use, for example to permit loading into the trunk of a car or into the front passenger compartment thereof by a disabled driver.

A collapsing-type frame is constructed, in accordance with a feature of the invention, by securing the central caster wheel 1001 to a short pipe length 801 (FIG. 7) which is somewhat larger than two forwardly projecting stubs ends of pipes 801*a*, 801*b* which, in turn, are secured to the longitudinal legs 12, 13, respectively. The assembly is held together by passing a rod 802 through the tubes 801*b*-801-801*a*, and securing the rod, at its ends, for example by wing nuts 802', so that it cannot slip out. The front part of the frame is then made of square tubing or otherwise shaped tubing so that the central section 801 cannot rotate with respect to the end sections 801*a*, 801*b*. Drop-in pins 803*a*, 803*b*, which may be spring-loaded, or merely retained irremovably, for example by a chain on the frame, provide maintenance of extended position of the respective telescoping frame parts 801*a*, 801*b* with respect to the central tube 801. For collapsing the lower frame, then, the pins 803*a*, 803*b* are removed, and the sections 801*a*, 801*b* can be pushed inwardly towards each other within the central tube 801. The rods 802, which can be tightened with wing nuts, will compress the tubes 801*a*, 801*b* against the pins 803*a*, 803*b*, which are positioned eccentrically so that rigidity of the frame is insured. Assembly and disassembly is simple since it is only necessary to loosen one wing nut. Preferably, the fits between the tubes 801*a*, 801*b* and the central tube 801 are snug, but sufficiently loose to permit ready sliding movement. A ball detent, or the like, should be used to prevent removal of the respective end portions 801*a*, 801*b* from the central portion 801 upon extension of the tubes. Once assembled together, it will then become impossible to separate the two halves of the base, since the two pairs of telescopic tubes are retained within the central tube.

Figure 7:
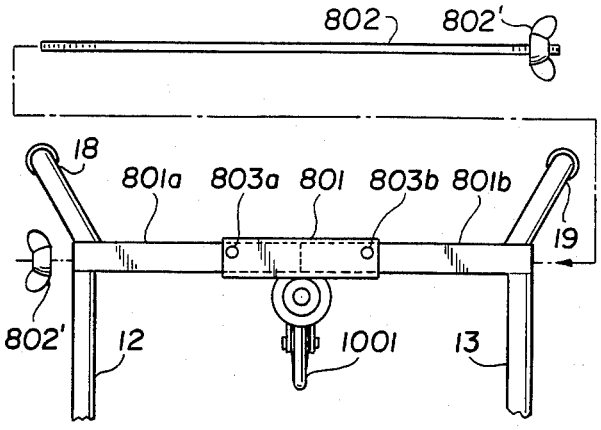
FIG. 7 is a fragmentary schematic plan view of a telescoping arrangement for the lower frame.

In accordance with another embodiment which, however, does not permit collapse to quite the distance of FIG. 7, one of the tubes extends from one side of the frame and receives, telescopically, the other. The larger one has the central caster 1001 secured thereto, for example by welding. Since the tube sections will have different diameter, the frame will not be perfectly balanced and, while structurally simple, this may not be a preferred embodiment for most users. Placing retaining pins, and, in addition, ball and spring detents or the like, to prevent separation of the inner tubes 801*a*, 801*b* from the outer ones, will still permit locking of the system in position, and assure that the front caster wheel cannot become detached even if the user should forget to insert the holding rod 802 and tighten it securely. In this embodiment, the leg portions 12, 13 and the cross-connecting portion 1023 will be formed as initially separate elements, for example welded together. The arrangement has the advantage the frame may be closed to approximately half its width; collapsing can be done by the impaired person her/himself, and removal of the rod 802, after collapse, is simple and can be accomplished by the person, or by a companion. Closing the frame simply requires removal of one wing nut to obtain the advantage of the lesser width, and then pulling out the rod 802. The frame will, however, remain upright and extended, even while being collapsed, thus permitting a disabled person to pull it into a car on its wheels while, as it is being collapsed, affording stability and support, or a place to lean on.

Figure 8:
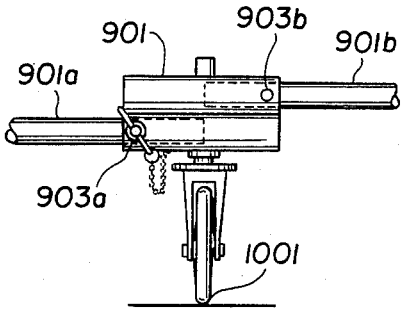
FIG. 8 is a fragmentary schematic view of another telescoping arrangement for the lower frame and providing for optimum balance thereof.
Figure 5:
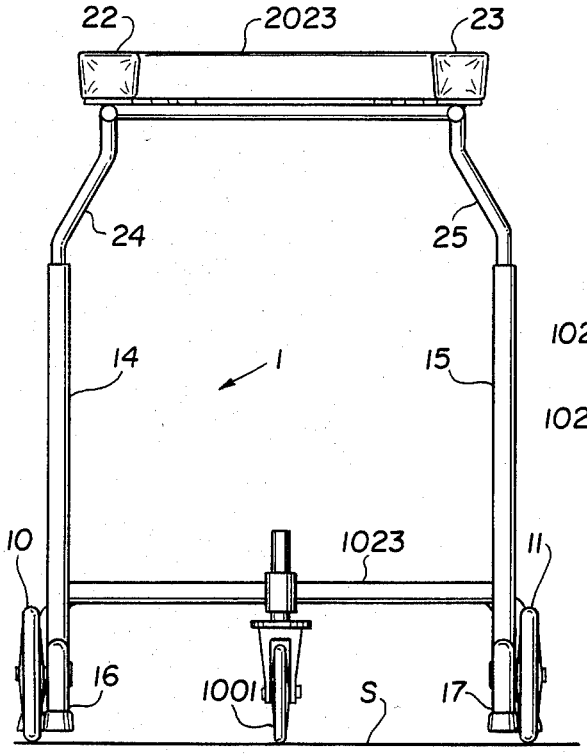
FIG. 5 is a rear elevational view.

FIG. 8 illustrates a preferred form of a collapsing-type frame in which optimum right-left balance of the frame is maintained, while permitting collapse thereof.

As shown in the upright front view, the two horizontal tubular portions 901*a*, 901*b*, and forming the forward part of the frame, are offset vertically by slightly more than the diameter of the respective tubes, and joined together by a dual-tube 901, in which they can slide. The housing for the caster wheel 1001 is welded to the dual-tube central section 901. Bolts and nuts 903*a*, 903*b*, preferably attached so that they cannot be lost, can then be passed through suitable matching holes in the dual-tube section 901 and through the single-tube sections 901*a*, 901*b*, respectively. The single-tube sections, thus, are securely connected by the unitary double section 901 and, since the same quantity of metal is symmetrically located with respect to the forward wheel 1001, optimum balance of the frame is maintained. The length of the central dual-tube section 901, preferably, is about half the width of the frame, so that it can be collapsed to about half its normal width upon removal of the bolts 903*a*, 903*b*, and suitably extended without loss of stability. The inner and outer diameters of the tubes 901*a*, 901*b* and of the dual tubular element 901 should be so selected that a snug sliding fit is obtained free from any wobble. More than one bolt 903*a*, 903*b* may be desirable on each side. FIG. 8 shows the tubes in their extended position.

It is also necessary that the plan dimension of the padded front and steering bar of the upper section of the frame be reduced. The upper portion can be constructed similarly—except for the padding—by providing a telescopic steering bar 2023*a*; in accordance with a feature of the invention, however, the upper section of the U-shaped frame structure does not fold, but is moved forwardly as a unit and away from the sides, to be then pivoted up or downward, through 90°, out of the way.

Figure 9:
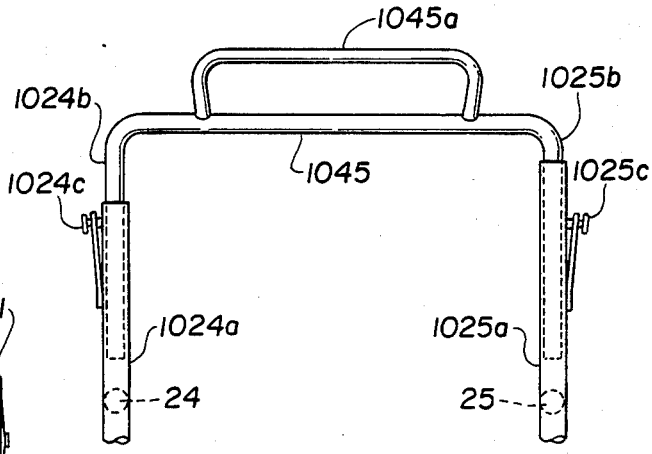
FIG. 9 is a fragmentary top view of a telescoping arrangement for the upper frame.

The upper portions or tube sections 24, 25 then are secured to a tubular frame structure which is formed of two horizontal elements 1024*a*, 1025*a*, which receive, telescopically, the side portions 1024*b*, 1025*b* of the connecting structure 1023, which is generally U-shaped and has a connecting pipe or tube 1045 and a forward grab bar 1045*a* secured thereto, for example by welding, or formed as an integral unit. The arm pads 22, 23 (FIG. 1, for example) are secured to the outer telescopic tubes 1024*a*, 1025*a*, respectively, and the forward cross pad 2023 is secured to the cross pipe 1045. The leg portions 1024*b*, 1025*b* are retained in position by spring clips 1024*c*, 1025*c*, for example of the rim-and-eye type, with a lever release on each side. When the clips are pulled outwardly or, in accordance with a reverse embodiment, when the clips are released, the front section formed of the legs 1024*b*, 1025*b* and the cross element 1045, together with the grab bar 1045*a*, can slide forwardly, clearing the ends of the tubes. In accordance with a feature of the invention, one of the outer telescopic upper tubes, for example the tube 1025*a*, is made longer by some distance than that of the other tube. Thus, as the forward portion is pulled forwardly, for example by grabbing the grab bar 1045*a*, the end of the leg portion 1024*b* will first clear the edge of the associated tube 1024*a*, thus permitting the forward assembly to swing downwardly without, however, entirely removing it. This permits the structure to be collapsed, by releasing the pins 803*a*, 803*b*, or bolts 903*a*, 903*b* in the lower frame portion, without, however, having any odd element which requires separate carrying. Re-assembling the walking frame is easily and safely accomplished by first pulling apart the two sides of the lower frame, then for example pulling forwardly the grab bar 1045*a*, inserting the end of the leg 1024*b* into the end of the corresponding tube 1024*a*, and then pushing the forward assembly, for example by pulling on the grab bar 1045*a*, to reestablish the assembled position as shown in FIG. 9. At that point, the walking aid is fully assembled and can be used, and can fully support a person. For utmost stability during movement of the frame of FIG. 7, rod 802 is then inserted, and the lower frame locked in position by the pins 803*a*, 803*b*. Even before the lower frame is locked, however, the entire walking aid can provide support for the disabled person.

To re-assemble the frame of FIG. 8, it is only necessary to pull out the respective frame sections and reinsert the bolts and wing-nut connections 903*a*, 903*b*. Suitable stops interiorly of the dual-tube 901 and/or the pull-out sections 901*a*, 901*b* prevent excessive travel; such stops can be formed, for example, by inward punches, spring-loaded ball-and-detent arrangements, and the like, as well known in structural assemblies.

The frame can never collapse on its user, or drift apart into two separate, unsupported side units due to the interconnection of the telescopic pipes. The foldable frame allows greater flexibility of the weight of the unit, since there are more separate pieces which can be made, selectively, of tubular steel or aluminum. The final weight of the walking aid thus can be tailored to individual uses without requiring excessive welding of dissimilar materials.

The stability of the frame makes it highly suitable for use when falling is to be avoided at all costs. It is particularly adapted for use by impaired persons having structural diseases, or by the elderly. It advances in pace with the person using it, and does not require a timed operation, such as canes or "walkers" or crutches. It is thus suitable also for learning to walk again after a trauma, or for those learning to walk the first time after corrective surgery for example. The walker also affords physical protection since it surrounds the user, which is particularly important for operation in crowds, or where a frail or small person could be knocked down. Use of heavy-weight materials for the lower frame, such as steel piping, combined with light-weight materials for the upper portions of the frame, such as aluminum tubing, e.g. for the support struts 24, 25 and the frame portions 1024*a,* 1025*a,* 1024*b,* 1025*b,* 1045, if used, or for equivalent aluminum boards or pads, permits excellent stability and operability over surfaces which are uneven, rough, ridged, or have holes, such as potholes in streets or sidewalks.

Various changes and modifications may be made, and features described in connection with any one of the embodiments may be used with any of the others, within the scope of the inventive concept.

If desired, of course, one or more of the wheels, preferably the rear wheels, may have brakes associated therewith, for example similar to bicycle caliper-type brakes acting on the rims, and operated by Bowden cables secured to a handle, for example attached to the front steering bar 2023*a,* or at any other suitable location convenient for the user, so that the wheels can be braked without tipping or moving the frame.

I claim:

1. Walking aid for handicapped persons, having a frame (1);

wheel means (10, 11, 1001) on the frame for rolling movement thereof over a surface (S);

and a support structure adapted for engagement by the upper extremities of the using person secured to the frame;

wherein, in accordance with the invention, the wheel means comprise three wheels (10, 11, 1001);

the frame comprises a lower, generally U-shaped structure having a pair of parallel legs (12, 13) and a connecting frame element (1023), one each of the wheels (10, 11) being mounted laterally of the respective legs (12, 13) on the free end portions thereof for rotation in a plane essentially perpendicular to said surface, and about fixed axes of rotation, transverse to the U-shaped structure, the third wheel (1001) being a caster wheel means secured to the connecting element (1023) centrally thereof for rotation about an axis parallel to said surface and for swiveling about an axle which is freely movable about a vertical swivel axis, and projecting spurs (16–19) extending downwardly and terminating short of contact with the surface (S) leaving a clearance, two spurs (16, 17) each being positioned at one of the respective free end portions of the U-shaped structure and extending rearwardly and downwardly therefrom, and two spurs (18, 19) each being secured to one of the respective laterally spaced portions of the legs adjacent the connecting element (1023) and extending outwardly and downwardly therefrom, the lower end of each spur being positioned a slight distance above the surface to provide assurance against accidental tipping and provide braking on controlled tipping of the walking aid;

and wherein the support structure comprises a pair of upright struts (14, 15; 24, 25) each extending upwardly from a location behind the center of a respective one of the parallel legs (12, 13) of the generally U-shaped structure, and a support surface (20) of generally U-shaped planar outline, secured to the upright struts and positioned in approximate alignment with the U-shaped structure, and adapted for supporting and partly surrounding the person.

2. Walking aid according to claim 1, wherein the upright struts (14, 15) have a lower portion secured to the legs (12, 13) of the U-shaped structure and extend upwardly, and an upper portion (24, 25) which is inwardly—with respect to the U-shaped structure—offset, the upper portion supporting said support surface (20).

3. Walking aid according to claim 2, further comprising stablilizing struts (14*a,* 15*a*) extending from the upright struts (14, 15) to the legs of the U-shaped structure to form a triangle connection therewith.

4. Walking aid according to claim 3, wherein the upright struts and the stabilizing struts form the sole connection between the support surface and the U-shaped structure to leave the forward portion of the walking aid free and unimpeded.

5. Walking aid according to claim 4, wherein the U-shaped structure and at least the lower portion of the upright struts (14, 15) comprise tubular steel; and wherein the support structure (20) and at least the upper portion (24, 25) of the uprights struts comprises light-weight material to place the center of gravity of the walking aid close to the U-shaped structure.

6. Walking aid according to claim 1, wherein the legs (12, 13) of the U-shaped structure have a forward portion adjacent the connecting element (1023) which is upwardly offset with respect to the free end portion of said legs.

7. Walking aid according to claim 6, further comprising stabilizing struts (14*a,* 15*a*) extending from the upright struts (14, 15) to the legs of the U-shaped structure to form a triangle connection therewith; and wherein said stabilizing struts are connected to the upwardly offset portions of the legs (12, 13).

8. Walking aid according to claim 1, wherein the spurs (16, 17) at the free end portions of the legs (12, 13) project essentially in rearward alignment with said legs and downwardly, and the spurs (18, 19) adjacent the connecting element (1023) project forwardly and downwardly, and are angled outwardly to be positioned essentially in line with or outwardly of the running surface of the wheels (10, 11) attached to the legs (12, 13) of the frame.

9. Walking aid according to claim 1, wherein the swivel axis of the caster wheel means (1001) and the outer, lower ends of the spurs adjacent the connecting element (1023), in plan view, are located at the apices of a triangle.

10. Walking aid according to claim 1, wherein the engagement point of the caster wheel means (1001), when pivoted in position about the swivel axis for forward running movement of the walking aid, and the outer ends of the spurs (18, 19) adjacent the connecting element, in plan view, form the apices of a triangle.

11. Walking aid according to claim 1, wherein the support surface (20) comprises two parallel leg portions (22, 23) and a connecting surface element (2023);

and wherein the connecting frame element (1023) and said legs (12, 13) form a rigid, unitary structure, and said two leg portions (22, 23) and the connecting support surface element (2023) form a separate, unitary structure.

12. Walking aid according to claim 1, wherein (FIG. 7) the connecting element comprises a telescoping structure having at least two non-rotatable telescoping pipes of larger and smaller diameter, respectively, the caster wheel means (1001) being secured to the pipe of larger diameter;

latching means (803*a*, 803*b*) are provided to latch the telescoping pipes (801*a*, 801, 801*b*) in respectively extended position;

and a connecting rod (802) is provided, engageable into and through the telescopically received pipes, and securing said pipes together and in position.

13. Walking aid according to claim 12, wherein two pipes of smaller diameter are provided, secured to the legs (12, 13);

a central pipe (801) is provided, to which said caster wheel (1001) is attached, said pipes (801*a*, 801*b*) secured to the legs being telescopically received within the central pipe (801), and the locking means comprises two lock elements (803*a*, 803*b*) to lock the larger, central pipe to the lateral pipes (801*a*, 801*b*) telescopically receivable therein.

14. Walking aid according to claim 1, wherein (FIG. 8) the connecting element comprises a telescoping structure having two pipes (901*a*, 901*b*) which are out-of-alignment with respect to each other and have end portions laterally adjacent each other, said two pipes having the same weight-per-unit length characteristics;

a common dual-pipe element (901) telescopically receiving said two pipes, the caster wheel means (1001) being secured to said dual element;

and latching means (903*a*, 903*b*) releasably latching each of said telescoping pipes in respectively extended, or pushed-against-position within the dual-pipe element.

15. Walking aid according to claim 14, wherein the latching means comprises a bolt-wing nut connection.

16. Walking aid according to claim 14, wherein the support structure comprises (FIG. 9) two forwardly extending legs (1024*a*, 1025*a*);

a cross-connecting element (1045) having U-shaped extending leg portions (1024*b*, 1025*b*) telescopically receivable within said legs (1024*a*, 1025*a*);

latching means (1024*c*, 1025*c*) latching the telescopic elements together;

and wherein a padded arm rest structure (22, 23, 2023) is provided, respectively formed in three separate elements, two of which are connected to said legs (1024*a*, 1025*a*) and a third element being connected to the cross-connecting element (1045).

17. Walking aid according to claim 1, wherein the support structure comprises (FIG. 9) two forwardly extending legs (1024*a*, 1025*a*);

a cross-connecting element (1045) having U-shaped extending leg portions (1024*b*, 1025*b*) telescopically receivable within said legs (1024*a*, 1025*a*);

latching means (1024*c*, 1025*c*) latching the telescoping elements together;

and wherein a padded arm rest structure (22, 23, 2023) is provided, respectively formed in three separate elements, two of which are connected to said legs (1024*a*, 1025*a*) and a third element being connected to the cross-connecting element (1045).

18. Walking aid according to claim 1, further including a steering bar (2023*a*) secured to the support surface (20) and projecting forwardly in form of a ball to a position in advance of the swivel axis of said caster wheel means.

19. Walking aid according to claim 1, wherein the support structure comprises light-weight metal; the support surface (20) comprises elastic foam padding blocks secured in U-shaped configuration to the light-weight metal of the support structure;

and a steering bar (2023*a*) secured to the support surface and projecting forwardly in form of a bail to a position in advance of the swivel axis of the caster wheel means.

* * * * *